US010218106B2

(12) United States Patent
Wang et al.

(10) Patent No.: US 10,218,106 B2
(45) Date of Patent: Feb. 26, 2019

(54) TERMINAL POSITION ASSURANCE MEMBER, TERMINAL ASSEMBLY, CONNECTOR HOUSING ASSEMBLY AND CONNECTOR

(71) Applicant: TYCO ELECTRONICS (SHANGHAI) CO. LTD., Shanghai (CN)

(72) Inventors: Elison Wang, Shanghai (CN); Xiao Zhou, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/101,875

(22) PCT Filed: Dec. 8, 2014

(86) PCT No.: PCT/IB2014/066689

§ 371 (c)(1),
(2) Date: Jun. 3, 2016

(87) PCT Pub. No.: WO2015/083140

PCT Pub. Date: Jun. 11, 2015

(65) Prior Publication Data

US 2017/0033490 A1 Feb. 2, 2017

(30) Foreign Application Priority Data

Dec. 6, 2013 (CN) ..... 2013 2 0802415 U

(51) Int. Cl.
*H01R 9/05* (2006.01)
*H01R 13/426* (2006.01)
*H01R 11/05* (2006.01)

(52) U.S. Cl.
CPC ..... *H01R 13/426* (2013.01); *H01R 11/05* (2013.01)

(58) Field of Classification Search
CPC ..... H01R 13/426; H01R 11/05; H01R 13/62; H01R 13/639; H01R 13/641;
(Continued)

(56) References Cited

U.S. PATENT DOCUMENTS 3,877,772 A * 4/1975 De Cenzo ..... H01R 31/02 439/724
5,425,653 A * 6/1995 Koiso ..... H01R 13/6272 439/347

(Continued)

FOREIGN PATENT DOCUMENTS

WO WO 2012085667 A1 * 6/2012 ..... H01R 13/4362

OTHER PUBLICATIONS

International Search Report and Written Opinion issued by the European Patent Office, dated Feb. 16, 2015 for International Application No. PCT/IB2014/066689; 9 pages.

*Primary Examiner* — Edwin A. Leon
*Assistant Examiner* — Milagros Jeancharles
(74) *Attorney, Agent, or Firm* — Faegre Baker Daniels LLP

(57) ABSTRACT

The invention discloses a terminal position assurance member, including a base plate having an upper surface and a lower surface and extending from the upper surface to the lower surface; a trough hole being provided at a middle portion of the base plate, and the through hole extending from the upper surface to the lower surface; at least one first insertion 5 member extending from the upper surface of the base plate and protruding out of the base plate a selected height, the first insertion member having a lateral surface along its extension direction; and a second insertion member extending from the upper surface of the base plate and protruding out of the upper surface; the first insertion member is provided with at least two protrusions which extend from the lateral surface of the first insertion member
(Continued)

and 10 protrude out of the lateral surface of the first insertion member; said at least two protrusions are arranged to be spaced from one another along the height direction of the first insertion member. The invention can enable the terminal position assurance member to be pre-mounted and then completely mounted in place in use.

19 Claims, 6 Drawing Sheets

(58) Field of Classification Search
CPC ..... H01R 13/6272; H01R 13/6275; H01R 13/4361; H01R 13/4362; H01R 13/4223; H01R 13/5208; H01R 13/5205; H01R 13/5221
USPC ..... 439/352, 489, 582, 752, 587, 593, 595, 439/345, 358
See application file for complete search history.

(56) References Cited

U.S. PATENT DOCUMENTS 6,217,388 B1 * 4/2001 Francis ..... H01R 13/7197 439/352
6,276,953 B1 * 8/2001 Gauker ..... H01R 13/7032 439/352
6,419,510 B2 * 7/2002 Shiraki ..... H01R 13/7032 439/188
6,530,799 B2 * 3/2003 Regnier ..... H01R 13/6273 439/352
6,866,534 B2 * 3/2005 Hirschmann ..... H01R 13/639 439/188
6,893,277 B2 * 5/2005 Parrish ..... H01R 13/506 439/188
6,945,801 B2 * 9/2005 Brown ..... H01R 13/641 439/188
7,131,854 B1 * 11/2006 Pavlovic ..... H01R 13/6273 439/352
7,189,096 B2 * 3/2007 Miksche ..... H01R 13/6273 439/352
7,229,304 B2 * 6/2007 Annecke ..... H01R 13/52 439/281
7,229,305 B2 * 6/2007 Hirschmann ..... H01R 13/6273 439/352
7,294,013 B2 * 11/2007 Nakamura ..... H01R 13/6633 439/489
7,396,253 B2 * 7/2008 Nakamura ..... H01R 13/641 439/188
7,470,138 B1 * 12/2008 Chen ..... H01R 13/506 439/352
7,578,694 B2 * 8/2009 Takahashi ..... H01R 13/506 439/352
7,909,638 B2 * 3/2011 Seo ..... H01R 13/6272 439/352
8,968,021 B1 * 3/2015 Kennedy ..... H01R 13/6273 439/352
9,130,306 B2 * 9/2015 Hotea ..... H01R 13/506
9,325,114 B2 * 4/2016 Miklinski ..... H01R 13/6273
9,941,636 B2 * 4/2018 Jodon De Villeroche ..... H01R 13/5202
2002/0081888 A1 * 6/2002 Regnier ..... H01R 13/6273 439/352
2002/0086575 A1 7/2002 Marpoe et al.
2002/0160645 A1 * 10/2002 Nagamine ..... H01R 13/6273 439/352
2003/0162444 A1 * 8/2003 Hayashi ..... H01R 13/719 439/620.05
2004/0248454 A1 * 12/2004 Gunreben ..... H01R 13/639 439/352
2006/0154510 A1 * 7/2006 Annecke ..... H01R 13/6273 439/352
2007/0178739 A1 * 8/2007 Kuwayama ..... H01R 13/6272 439/352
2007/0254518 A1 * 11/2007 Nealle ..... H01R 13/6277 439/352
2013/0309884 A1 * 11/2013 Pamart ..... H01R 9/032 439/108
2015/0311633 A1 * 10/2015 Miklinski ..... H01R 13/6273 439/345
2017/0012392 A1 * 1/2017 Kot ..... H01R 13/03
2017/0222349 A1 * 8/2017 Kleymann ..... H01R 13/4361
2018/0151989 A1 * 5/2018 Pamart ..... H01R 13/11

* cited by examiner

TERMINAL POSITION ASSURANCE MEMBER, TERMINAL ASSEMBLY, CONNECTOR HOUSING ASSEMBLY AND CONNECTOR

FIELD OF THE INVENTION

The present invention relates to a terminal position assurance member, a terminal assembly, a connector housing assembly and a connector.

BACKGROUND OF THE INVENTION

A high-voltage electricity connector is a commonly-used adapter in electrical power transmission which is used to connect two cables or connect a cable with an electricity consumption equipment. It is configured as an insertion structure for purpose of easy use or organization. However, the insertion structure is liable to be loosed or disengaged during frequent use, and thereby it is desirable to use a terminal position assurance (TPA) member to secure the insertion structure. However, for the terminal position assurance member in the prior art, it must be mounted in place on a connector by using a special tool, and the mounting procedure is complicated. Furthermore, during mounting, it can only be mounted in place in one-step, not in multiple steps. Housings and the terminal position assurance members can only be separately stored so that storage and transport thereof are inconvenient.

SUMMARY OF THE INVENTION

One of the objects of the present invention is to provide a terminal position assurance member which can be conveniently mounted and stably retained at a desired position, to overcome the drawbacks in the prior art.

To achieve the above object, the present invention employs the following technical solution.

A terminal position assurance member, characterized in that it comprises:

- a base plate having an upper surface and a lower surface and extending from the upper surface to the lower surface; a trough hole being provided at a middle portion of the base plate, and the through hole extending from the upper surface to the lower surface;
- at least one first insertion member extending from the upper surface of the base plate and protruding out of the base plate a selected height, the first insertion member having a lateral surface along its extension direction; and
- a second insertion member extending from the upper surface of the base plate and protruding out of the upper surface;
- the first insertion member is provided with at least two protrusions which extend from the lateral surface of the first insertion member and protrude out of the lateral surface of the first insertion member;
- said at least two protrusions are arranged to be spaced from one another along the height direction of the first insertion member.

Preferably, said at least two protrusions are arranged to be staggered from one another along the width direction of the first insertion member.

Preferably, lower surfaces of the at least two protrusion are planar surfaces extending perpendicularly from the lateral surface of the first insertion member.

Preferably, the at least two protrusions comprise an upper protrusion and a lower protrusion, wherein an upper surface of the upper protrusion is an oblique surface.

Preferably, the at least two protrusions comprise an upper protrusion and a lower protrusion, wherein an upper surface of the lower protrusion is a planar surface extending perpendicularly from the lateral surface of the first insertion member.

Preferably, the number of the first insertion members is no less than two, and said no less than two first insertion members are disposed around the through hole; the at least two protrusions comprise an upper protrusion and a lower protrusion.

Preferably, upper surfaces of some of the lower protrusions are planar surface extending perpendicularly from the lateral surfaces of the first insertion members; upper surfaces of some of the lower protrusions are oblique surfaces.

Preferably, at least one of the first insertion member and second insertion member is in the shape of a plate, a plate strip or a rod.

A second object of the present invention is to provide a connector housing assembly which can be conveniently mounted and stably used, to overcome the drawbacks in the prior art.

To achieve the above object, the present invention employs the following technical solution.

A connector housing assembly, characterized in that it comprises:

- a housing provided with a first insertion hole and a second insertion hole; the first insertion hole and the second insertion hole are connected to each other; an inner wall of the first insertion hole is provided with a step protruding out of the inner wall; and
- a terminal position assurance member comprising: a base plate, at least one first insertion member and at least one second insertion member; the base plate has an upper surface and a lower surface and extends from the upper surface to the lower surface; a trough hole is provided at a middle portion of the base plate, and the through hole extends from the upper surface to the lower surface; the first insertion member extends from the upper surface of the base plate and protrudes out of the base plate a selected height, and the first insertion member has a lateral surface along its extension direction; the first insertion member is provided with an upper protrusion and a lower protrusion which extend from the lateral surface of the first insertion member and protrude out of the lateral surface of the first insertion member; the upper protrusion and the lower protrusion are arranged to be spaced from one another along the first insertion member in its extension direction;

the terminal position assurance member is disposed at the first insertion hole; the base plate is located outside the first insertion hole and the first insertion member is inserted into the first insertion hole; when the first insertion member is inserted into the first insertion hole, the terminal position assurance member is located at a pre-mounted position and a final position respectively, wherein at the pre-mounted position, the step is located between the upper protrusion and the lower protrusion and retains the first insertion member at this position; at the final position, the lower protrusion passes over the step and is stopped by the step so that the first insertion member is retained at this position and cannot be withdrawn from the first insertion hole.

Preferably, the upper protrusion and the lower protrusion are arranged to be staggered from one another along the width direction of the first insertion member.

Preferably, a lower surface of the upper protrusion and a lower surface of the lower protrusion are planar surfaces extending perpendicularly from the lateral surface of the first insertion member.

Preferably, an upper surface of the upper protrusion is an oblique surface.

Preferably, an upper surface of the lower protrusion is a planar surface extending perpendicularly from the lateral surface of the first insertion member.

Preferably, the number of the first insertion members is no less than two, and said no less than two first insertion members are disposed around the through hole.

Preferably, upper surfaces of some of the lower protrusions are planar surfaces extending perpendicularly from the lateral surfaces of the first insertion members; upper surfaces of some of the lower protrusions are oblique surfaces.

Preferably, the first insertion hole and the second insertion hole are arranged perpendicular to each other.

A third object of the present invention is to provide a terminal assembly which can be conveniently mounted and stably used, to overcome the drawbacks in the prior art.

To achieve the above object, the present invention employs the following technical solution.

A terminal assembly, characterized in that, it comprises:

a connection terminal;

a terminal base provided with a receiving cavity and an insertion aperture, the connection terminal being disposed within the receiving cavity, the insertion aperture being used to secure the terminal assembly within a corresponding housing; and a trigger disposed on the terminal base and protruding out of a surface of the terminal base.

Preferably, the terminal base has a mating hole and a cable insertion hole for connecting a mating connector and a cable respectively; the cable extends into the cable insertion hole and is connected with the connection terminal.

Preferably, it further comprises a shielding structure which is cladded external to the terminal base; the trigger is configured to protrude out of the shielding structure.

A fourth object of the present invention is to provide a connector which can be conveniently mounted and stably used, to overcome the drawbacks in the prior art.

To achieve the above object, the present invention employs the following technical solution.

A connector, characterized in that it comprises the aforesaid connector housing assembly and aforesaid terminal assembly; the terminal base is mounted in the second insertion hole via the terminal position assurance member; the terminal position assurance member is inserted into the first insertion hole.

Preferably, the terminal position assurance member is located at the pre-mounted position and configured to be movable from the pre-mounted position to the final position.

Preferably, the terminal assembly is inserted into the second insertion hole of the housing, the trigger pushes the first insertion member to tilt as the terminal assembly is inserted into the second insertion hole so as to enable the first insertion member to be moved further into the first insertion hole until the lower protrusion is stopped by the step.

Preferably, the terminal assembly is inserted into the second insertion hole of the housing, and the second insertion member is inserted into the insertion aperture to retain the terminal assembly in the second insertion hole of the housing.

Preferably, the extension direction of the second insertion member is perpendicular to the direction along which the terminal assembly is withdrawn from the second insertion hole.

Preferably, at least one of the first insertion member and second insertion member is in the shape of a plate, a plate strip or a rod.

Preferably, the terminal position assurance member is mounted in the first insertion hole via the first insertion member, and the second insertion member retains the terminal base within the second insertion hole.

According to the terminal position assurance member, the connector housing assembly and the electrical connector in the present invention, the terminal position assurance member is enabled to be pre-mounted and then completely mounted in place when in use. In the pre-mounted state, it can be ensured that the terminal position assurance member is stably connected with the housing without disengagement, and that convenient mounting is provided upon completely mounted. The trigger may be used to deform the first insertion member to reduce the resistance when the terminal position assurance member moves from the pre-mounted state to the completely-mounted state, providing more convenient assembling and saving procedures. The terminal position assurance member, after being completely mounted in place, exhibits stable and firm connection, uneasy disengagement and safe use.

DETAILED DESCRIPTION OF PREFERRED EMBODIMENTS

The present invention will be further described with reference to the embodiments and figures.

Figure 1:
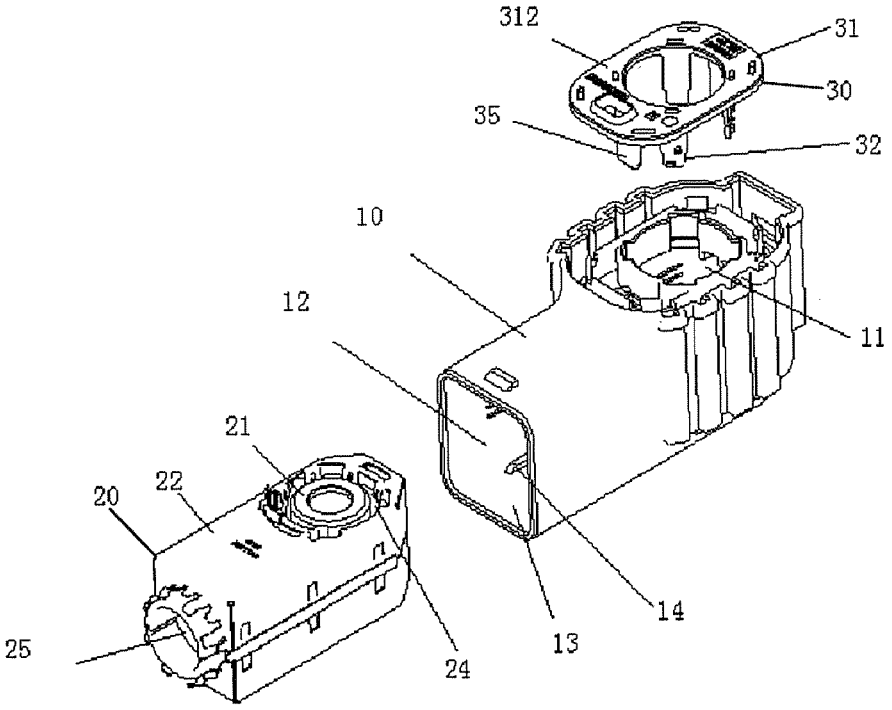
FIG. 1 is an exploded schematic view of the structure of the present utility mode.

As shown in FIG. 1, a connector comprises a housing 10, a terminal assembly 20 and a terminal position assurance member 30. As will be stated below, upon completion of assembling of the terminal connector, the terminal position assurance member 30 retains the terminal assembly 20 within the housing 10. The housing 10 and the terminal position assurance member are jointly called a connector housing assembly.

Figure 2:
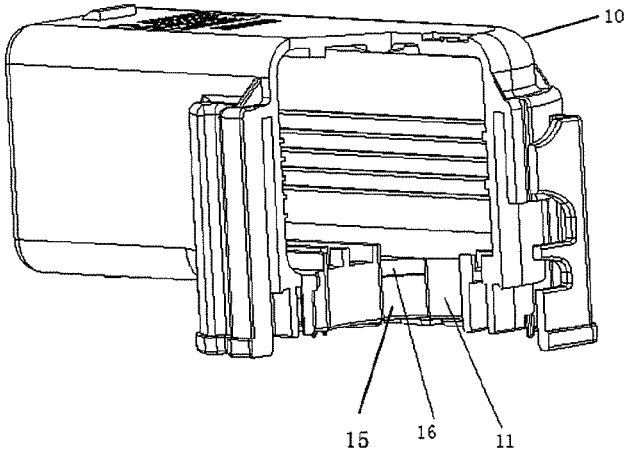
FIG. 2 is a partial cross sectional schematic view of a housing structure in the present invention.

The housing 10 is used to fixedly mount the terminal assembly 20. As shown in FIG. 1 and FIG. 2, the housing 10 is provided with a first insertion hole 11 and a second insertion hole 12 to respectively receive the terminal position assurance member 30 and the terminal assembly 20. For example, an inner wall 13 of the second insertion hole 12 is provided with a structure, such as one or more ribs 14 arranged along the insertion direction, to support the terminal assembly 20, to facilitate insertion of the terminal assembly 20 into the housing 10 through the second insertion hole 12 and disposed within the second insertion hole 12.

Figure 8:
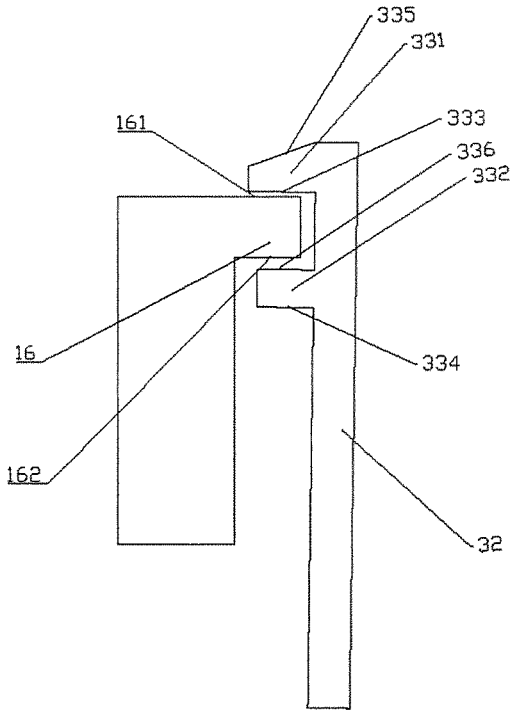
FIG. 8 is a schematic diagram illustrating interaction of the first insertion member with a step when the terminal position assurance member is at the pre-mounted position.

The first insertion hole 11 of the housing 10 is provided with a structure to connect with the terminal position assurance member 30. The terminal position assurance member 30 may be inserted through the first insertion hole 11 and connected in the first insertion hole 11 of the housing 10 so as to retain the terminal assembly 20 in the first insertion hole 11 and second insertion hole 12 of the housing 10. As shown in FIG. 1 and FIG. 2, an inner wall 15 of the first insertion hole in the housing 10 is provided with one or more steps 16 protruding from the surface thereof. A step 16 has an upper step surface 161 and a lower step surface 162, as shown in FIG. 8, to cooperate with the terminal position assurance member 30. The upper step surface 161 is a withdraw-preventing surface which may prevent the terminal position assurance member 30 from being accidentally withdrew out of the housing 10 from its pre-mounted position or final position. The lower step surface 162 is a stop surface which may prevent the terminal position assurance member 30, when in its pre-mounted state, from being accidentally moved from its pre-mounted position into its final position. Preferably, the upper step surface 161 and the lower step surface 162 are substantially perpendicular to the axial direction of the first insertion hole 11. In the example as shown in FIG. 2, the first insertion hole 11 and the second insertion hole 12 in the housing are arranged perpendicular to each other to be able to form a connector with a 90-degree angle.

Figure 3:
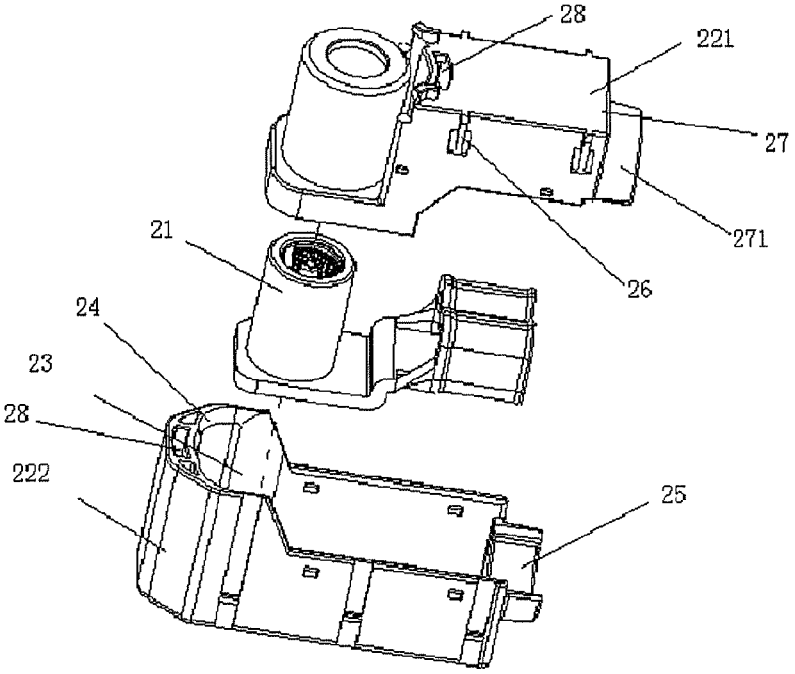
FIG. 3 is a schematic view showing the structure of a terminal assembly in the present invention.

As shown in FIG. 1 and FIG. 3, the terminal assembly 20 comprises a connecting terminal 21 and a terminal base 22. The terminal base 22 is provided with a receiving cavity 23, and the connecting terminal 21 is disposed within the receiving cavity 23 of the terminal base 22. In the example as shown in FIG. 3, the terminal base 22 comprises an upper base 221 and a lower base 222. The terminal base 22 of the terminal assembly 20 is provided with a mating hole 24 and a cable insertion hole 25. The cable insertion hole 25 is used to receive a cable (not shown in the figure) and allow it to pass therethrough. The mating hole 24 is used to connect with a mating connector (not shown in the figure) to achieve electrical connection between a cable connected with the terminal assembly 20 and a cable connected with the mating connector. The mating hole 24 is perpendicular to the cable insertion hole 25. The terminal assembly 20 is provided with a trigger 26 protruding from the terminal assembly 20. As will be stated below, during assembling of the terminal assembly 20 in the housing 10, the trigger 26 releases the terminal position assurance member 30 from its pre-mounted position so that the terminal position assurance member 30 may be moved to the final position to lock the terminal assembly 20 in the housing 10.

In a preferred embodiment of the present invention, the terminal assembly 20 further comprises a metal shielding layer 27 which is cladded external to the terminal base 22. The trigger 26 on the terminal assembly 20 is configured to protrude out of the metal shielding layer 27. The metal shielding layer 27 comprises a connection portion 271 which may be connected with a shielding layer (not shown) in the connected cable. In the example as shown in FIG. 1 or FIG. 3, the terminal assembly 20 is a substantially cuboid structure. In the example as shown in FIG. 1, the terminal base 22 is further provided with an insertion aperture 28 which is configured to mate with a second insertion member 35 on the terminal position assurance member 30 to lock the terminal position assurance member 30 within the housing 10 after assembling of the terminal connector.

Figure 4:
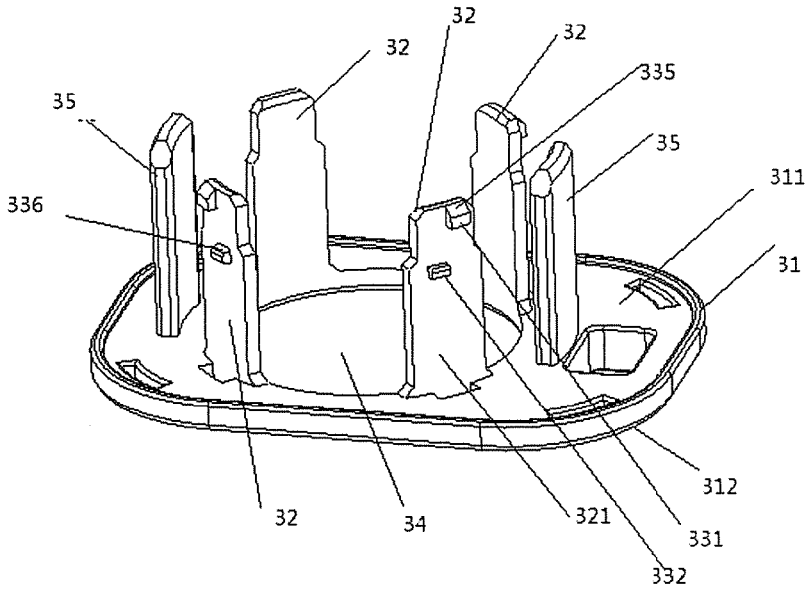
FIG. 4 is a schematic view showing the structure of a terminal position assurance member in the present invention.

As shown in FIG. 1 and FIG. 4, the terminal position assurance member 30 comprises a base plate 31 and a plurality of insertion members (e.g., four first insertion members 32 and two second insertion members 35) disposed on the base plate 31. The base plate 31 has an upper surface 311 and a lower surface 312. The base plate 31 extends from the upper surface 311 to the lower surface 312. A through hole 34 is provided at a middle portion of the base plate 31. The through hole 34 extends from the upper surface 311 to the lower surface 312 to allow the mating connector to pass therethrough during insertion.

The first insertion member 32 on the terminal position assurance member 30 is used for connection between the terminal position assurance member 30 and the housing 10. In the example shown in FIG. 4, the first insertion member 32 extends from the upper surface 311 of the base plate and protrudes out of the upper surface 311 a selected height which may be determined according to actual situations. The first insertion member 32 is provided with a latching structure to mount the terminal position assurance member 30 on the housing 10. For example, the latching structure on the first insertion member 32 may be configured as a protrusion 33. In the example as shown in the figure, the first insertion member 32 may be in the shape of a plate strip and has a lateral surface 321 along its extension direction, onto which the protrusion 33 is disposed. The protrusion 33 comprises an upper protrusion 331 and a lower protrusion 332. Each of the four first insertion member 32 may be provided with an upper protrusion 331 and a lower protrusion 332. In the example as shown in FIG. 4, the upper protrusion 331 is located above the lower protrusion 332. The upper protrusion 331 and lower protrusion 332 extend from the lateral surface 321 of the first insertion member and protrude out of the lateral surface 321 of the first insertion member. The upper protrusion 331 and lower protrusion 332 are arranged to be spaced apart from each other along the height direction (namely, the insertion direction of the terminal position assurance member 30) of the first insertion member 32, and staggered from each other along the width direction of the first insertion member 32. As will be stated in the following embodiment, the upper protrusion 331 and lower protrusion 332 may respectively engage with the step 16 on the housing 10 to retain the terminal position assurance member 30 at the pre-mounted position and final position with respect to the housing 10.

Figure 5:
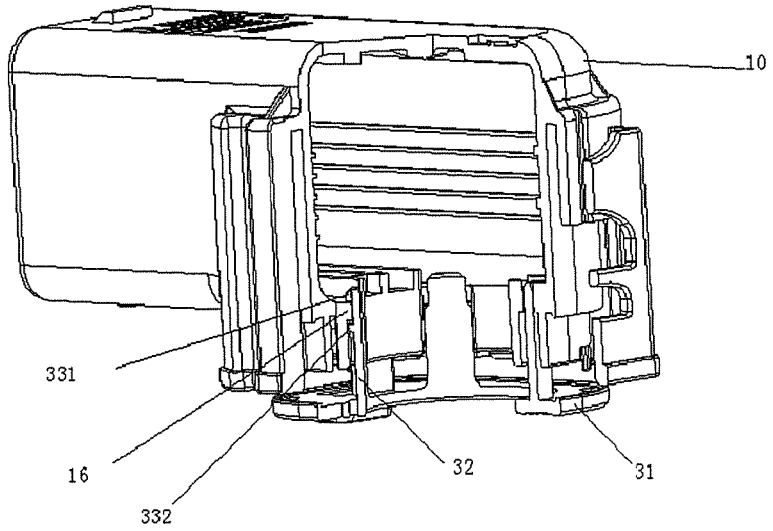
FIG. 5 is a partial sectional schematic view showing the structure when the terminal position assurance member is at a pre-mounted position.

In the example shown in FIG. 4, the four first insertion members 32 are provided with the same upper protrusions 331. Upper surfaces 335 of the upper protrusions 331 are all oblique surfaces, for example, the oblique surfaces of the upper surfaces 335 of the upper protrusions extend from the lateral surfaces 321 of the first insertion members towards the base plate 31. The oblique upper surfaces 335 of the upper protrusions facilitate the upper protrusions to pass over the step 16 to reach the pre-mounted position when the terminal position assurance member 30 is inserted into the first insertion hole 11, as shown in FIG. 5. Lower surfaces 333 of the upper protrusions 331 are planar surfaces extending from and perpendicular to the lateral surface 321 of the first insertion member to cooperate with the upper step surfaces 161 of the steps 16 at the pre-mounted position to prevent the terminal position assurance member 30 from accidentally falling out of the housing 10. Preferably, the lower surfaces 333 of the upper protrusions are planar surfaces extending perpendicularly from the lateral surface 321 of the first insertion member to provide a retention force that is required by the terminal position assurance member 30 at the pre-mounted position.

The lower protrusion 332 on the first insertion member 32 can be used to prevent the terminal position assurance member 30 from being further inserted from the pre-mounted position into the housing 10 to reach the final position. In a preferred embodiment of the present invention, the lower protrusion 332 of at least one first insertion member 32 has an upper surface 336 extending perpendicularly to the lateral surface 321 of the first insertion member to provide a desired stopping force to prevent the terminal position assurance member 30 from accidentally completely entering into the housing 10 to reach the terminal position. During assembling of the connector, one or more first insertion members 32 on the terminal position assurance member 30 will contact the trigger 26 on the terminal assembly 20, the lower protrusion 332 of the first insertion member 32 may be configured to have the upper surface 336 that extends perpendicularly to the lateral surface 321 of the first insertion member. Preferably, the lower protrusions 332 of the remaining first insertion members 32 are each provided with an oblique upper surface. In the terminal position assurance member 30 as shown in FIG. 4, the lower protrusions 332 of the two first insertion members 32 located at the left side each has an upper surface 336 that extends perpendicularly to the lateral surface 321 of the first insertion member, and the lower protrusions 332 of the two first insertion members 32 located at the right side each has an oblique upper surface (not shown in the figure).

A lower surface 334 of the lower protrusion is a planar surface extending from the lateral surface 321 of the first insertion member to cooperate with the upper step surface 161 of the step 16 at the final position so as to prevent the terminal position assurance member 30 from accidentally falling out of the housing 10. Preferably, the lower surface 334 of the lower protrusion is a planar surface extending perpendicularly from the lateral surface 321 of the first insertion member to provide a retention force that is required by the terminal position assurance member 30 at the final position.

The second insertion member 35 on the terminal position assurance member 30 is used for connection between the terminal position assurance member 30 and the terminal assembly 20. The second insertion member 35 extends from the upper surface 311 of the base plate 31 and protrudes out of the upper surface 311 a selected height. Two second insertion members 35 respectively correspond to the insertion apertures 28 on the terminal assembly 20. Upon completion of the assembling of the terminal connector, the second insertion members 35 on the terminal position assurance member 30 are inserted into the insertion apertures 28 on the terminal assembly 20 to lock the terminal position assurance member 30 in the housing 10. The second insertion members 35 may be in the shape of a plate strip. The assembling procedure of the terminal connector of the present invention will be described below with reference to the embodiment as shown in FIG. 5 through FIG. 8. During assembling of the terminal assembly 20 and the terminal position assurance member 30 with the housing 10, the terminal position assurance member 30 is first disposed on the housing 10 and retained at the pre-mounted position as shown in FIG. 5. During insertion of the terminal assembly 20 into the second insertion hole 12, the terminal position assurance member 30 may be released and then moved. The terminal position assurance member 30 may be moved to the final position and then retained at the final position, and maintain the terminal assembly 20 within the second insertion hole 12.

As shown in FIG. 5 and FIG. 8, before the terminal assembly 20 is inserted into the second insertion hole 12, the terminal position assurance member 30 is inserted into the first insertion hole 11 and located at the pre-mounted position. When in the pre-mounted position, the step 16 on the housing 10 is located, along the insertion direction, between the upper protrusion 331 and the lower protrusion 332 on the first insertion member 32 to retain the terminal position assurance member 30 at this position, namely, the pre-mounted position. At the pre-mounted position of the terminal position assurance member 30, the upper protrusion 331 may prevent the terminal position assurance member 30 from accidentally falling out of the housing 10, and the lower protrusion 332 prevents the terminal position assurance member 30 from being further inserted into the housing 10 to reach the final position. In a preferred embodiment of the present invention, the upper surfaces 336 of the lower protrusions on the two first insertion members 32 which are located on the left side of the terminal position assurance member 30 extend perpendicularly to the lateral surfaces 321 of the first insertion members to provide a stopping force that is required by the pre-mounted position to prevent the terminal position assurance member 30 from accidentally completely entering into the housing 10 to reach the final position.

Figure 6:
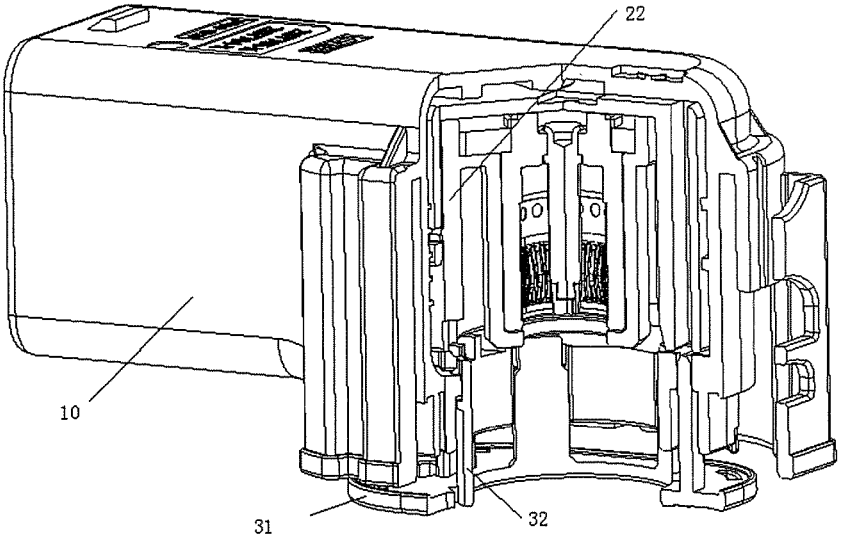
FIG. 6 is a schematic view showing the structure when the terminal assembly is inserted into the housing, triggering the terminal position assurance member.
Figure 9:
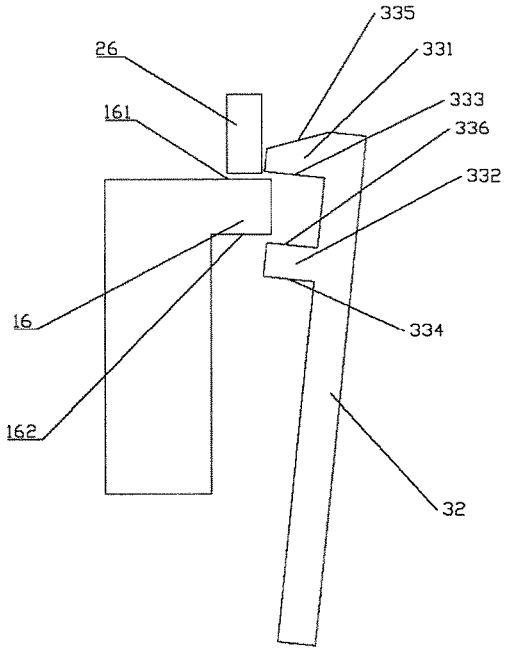
FIG. 9 is a schematic diagram illustrating interaction of the first insertion member with the step when the trigger is pushing the first insertion member.

As shown in FIG. 6 and FIG. 9, during mounting of the terminal assembly 20, the terminal assembly 20 is inserted through the second insertion hole 12 and disposed in the housing 10, and a front end of the terminal assembly 20 enters into part of the first insertion hole 11. During insertion of the terminal assembly 20 into the second insertion hole 12, the trigger 26 on the terminal assembly 20 contacts the upper protrusion 331 on at least one first insertion member 32 and then urges the first insertion member 32 to tilt through an insertion force. When the first insertion member 32 is tilted to a position as shown in FIG. 9, the upper surface 336 of the lower protrusion 332 on the first insertion member 32 does not contact the lower step surface 162 of the step 16 on the housing 10 any more so as to release the blocking exerted by the step 16 to the lower protrusion 332 on the first insertion member 32, reducing the resistance to the lower protrusion 332 for passing over the step 16 and enabling the first insertion member 32 to be further inserted into the first insertion hole 11. In a preferred embodiment of the present invention, during the insertion of the terminal assembly 20 into the second insertion hole 12, the trigger 26 on the terminal assembly 20 may release the stop blocking between the step 16 and the lower protrusions 332 on the two first insertion members 32 located at the left side of the terminal position assurance member 30. The lower protrusions 332 on the two first insertion member 32 located at the right side of the terminal position assurance member 30 are each provided with an oblique upper surface 337. Hence, when the two first insertion members 32 located at the left side is tilted as stated above, the two first insertion members 32 located at the right side will not block the terminal position assurance member 30 from entering into the first insertion hole 11.

Figure 7:
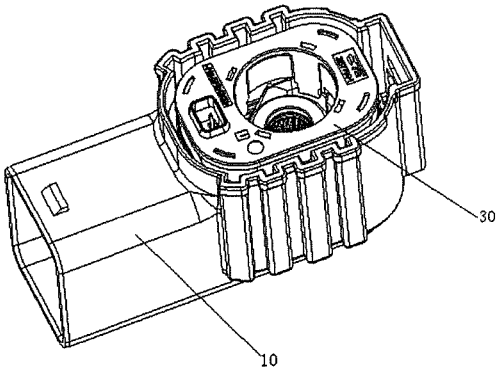
FIG. 7 is a schematic view showing the structure when the terminal position assurance member is at a final position.
Figure 10:
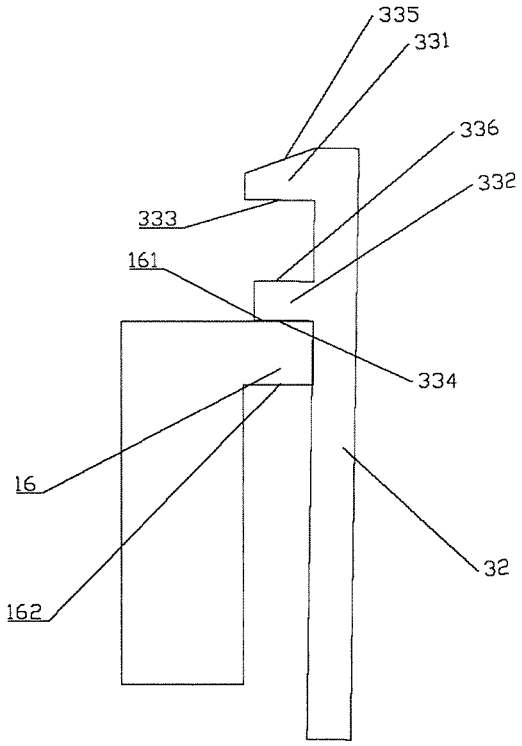
FIG. 10 is a schematic diagram illustrating the interaction of the first insertion member with the step when the terminal position assurance member is at the final position.

Exerting a pushing force onto the terminal position assurance member 30 along its insertion direction to continue to move the first insertion member 32 into the first insertion hole 11 until the lower protrusion 332 passes over the step 16 and is stopped by the step 16. The lower protrusion 332 is stopped by the step 16 after passing over the step 16 so that the first insertion member cannot be withdrawn from the first insertion hole 11. The first insertion member 32 is retained at a position as shown in FIG. 7 and FIG. 10, namely, the final position, through the cooperation of the step 16 with the lower surface 334 of the lower protrusion 332. During movement of the terminal position assurance member 30 from the pre-mounted position to the final position, the second insertion members 35 are inserted into the insertion apertures 28 of the terminal assembly 20. The second insertion members 35 are perpendicular to the direction in which the terminal assembly 20 is withdrawn from the second insertion hole 12. Hence, the second insertion members 35 retain the terminal assembly 20 within the connector housing 10.

The assembled terminal connector may be connected with a mating connector (not shown). After the terminal connection is connected with the mating connector, electrical connection is formed between the cable connected with the terminal assembly 20 and the cable connected with the mating connector.

The terminal connector described above may be used for electricity connection in high-voltage lines. When used for high-voltage electricity connection, the terminal assembly 20 is used as a cable fixation member for fixing high-voltage cables, and the terminal connector is then a high-voltage electrical connector. According to a preferred embodiment of the present invention, the terminal connector described above may be used for electrical connection of high-voltage lines of a vehicle such as an electrical vehicle or a hybrid vehicle.

Embodiments of the present invention are only used to illustrate the present invention and are not construed as limiting the scope of claims. Other substantively equivalent substitutions that can be envisaged by those skilled in the art all fall within the scope of the present invention.

What is claimed is:

1. A connector housing assembly, comprising:

a housing provided with a first insertion hole and a second insertion hole, wherein the first insertion hole and the second insertion hole are connected to each other, and the first and second insertions holes being arranged along first and second insertion axes;

and an inner wall of the first insertion hole is provided with a step protruding out of the inner wall; and a terminal position assurance member comprising:

a base plate, at least one first insertion member and at least one second insertion member; wherein the base plate has an upper surface and a lower surface and extends from the upper surface to the lower surface;

a through hole is provided at a middle portion of the base plate, and the through hole extends from the upper surface to the lower surface;

the first insertion member extends from the upper surface of the base plate and protrudes out of the base plate a selected height, and the first insertion member has a lateral surface along its extension direction;

the first insertion member is provided with an upper protrusion and a lower protrusion which extend from the lateral surface of the first insertion member and protrude out of the lateral surface of the first insertion member;

the upper protrusion and the lower protrusion are arranged to be spaced from one another along the first insertion member in its extension direction and the upper protrusion and the lower protrusion are arranged to be staggered from one another along a width direction of the first insertion member;

wherein lower surfaces of the at least two protrusions are planar surfaces extending perpendicularly from the lateral surface of the first insertion member;

wherein the terminal position assurance member is disposed at the first insertion hole;

the base plate is located outside the first insertion hole and the first insertion member is inserted into the first insertion hole;

when the first insertion member is inserted into the first insertion hole, the terminal position assurance member is located at a pre-mounted position and a final position respectively;

at the pre-mounted position, the step is located between the upper protrusion and the lower protrusion and retains the first insertion member at this position; and at the final position, the lower protrusion passes over the step and is stopped by the step so that the first insertion member is retained at this position and cannot be withdrawn from the first insertion hole, and in the final position, the second insertion member intersects with the second insertion hole.

2. The connector housing assembly according to claim 1, wherein the first insertion hole and the second insertion hole are arranged perpendicular to each other.

3. The connector assembly according to claim 1, wherein the first and second axes are disposed at an angle of substantially 90° to each other.

4. The connector housing assembly according to claim 1, wherein the second insertion member extends from the upper surface of the base plate and protrudes out of the base plate a selected height, and the second insertion member has a lateral surface along its extension direction that is perpendicular to the second axis.

5. The connector housing assembly according to claim 1, wherein lower surfaces of the at least two protrusions are planar surfaces extending perpendicularly from the lateral surface of the first insertion member.

6. The connector housing assembly according to claim 1, wherein the at least two protrusions comprise an upper protrusion and a lower protrusion, wherein an upper surface of the upper protrusion is an oblique surface.

7. The connector housing assembly according to claim 1, wherein the at least two protrusions comprise an upper protrusion and a lower protrusion, wherein an upper surface of the lower protrusion is a planar surface extending perpendicularly from the lateral surface of the first insertion member.

8. The connector housing assembly according to claim 1, wherein the at least two protrusions comprise an upper protrusion and a lower protrusion, upper surfaces of some of the lower protrusions are planar surface extending perpendicularly from the lateral surfaces of the first insertion members; upper surfaces of some of the lower protrusions are oblique surfaces.

9. A connector, comprising:

a connector housing;

a terminal position assurance member, comprising:

a base plate having an upper surface and a lower surface and extending from the upper surface to the lower surface, the base plate being formed with a through hole at a middle portion of the base plate extending from the upper surface to the lower surface;

at least one first insertion member extending from the upper surface of the base plate and protruding out of the base plate for a selected height, the first insertion member having a lateral surface along its extension direction; and a second insertion member extending from the upper surface of the base plate and protruding out of the upper surface;

the first insertion member is provided with at least two protrusions which extend from the lateral surface of the first insertion member and protrude out of the lateral surface of the first insertion member;

said at least two protrusions are arranged to be spaced from one another along a height direction of the first insertion member;

a terminal assembly comprising:

a connecting terminal;

a terminal base provided with a receiving cavity and an insertion aperture, the connecting terminal being disposed within the receiving cavity, the insertion aperture being used to secure the terminal assembly within a corresponding housing, the terminal position assurance member being positioned in the terminal base and having a pre-mounted position and a final position; and a trigger disposed on the terminal base and protruding out of a surface of the terminal base, the trigger being profiled to release the terminal position assurance member from its pre-mounted position so that the terminal position assurance member may be moved to the final position to lock the terminal assembly in the housing;

wherein the housing is provided with a first insertion hole and a second insertion hole; the first insertion hole and the second insertion hole are connected to each other; and an inner wall of the first insertion hole is provided with a step protruding out of the inner wall; wherein the terminal base is mounted in the second insertion hole via the terminal position assurance member; the terminal position assurance member is inserted into the first insertion hole; and wherein the terminal position assurance member is positioned at a pre-mounted position and configured to be movable from the pre-mounted position to the final position.

10. The connector according to claim 9, wherein the terminal base has a mating hole and a cable insertion hole for connecting a mating connector and a cable respectively; whereby the cable may extend into the cable insertion hole and connect with the connecting terminal.

11. The connector according to claim 10, wherein it further comprises a shielding structure which is cladded external to the terminal base; the trigger is configured to protrude out of the shielding structure.

12. The connector according to claim 9, wherein the terminal assembly is inserted into the second insertion hole of the housing, the trigger pushes the first insertion member to tilt as the terminal assembly is inserted into the second insertion hole so as to enable the first insertion member to be moved further into the first insertion hole until the lower protrusion is stopped by the step.

13. The connector according to claim 9, wherein the terminal assembly is inserted into the second insertion hole of the housing, and the second insertion member is inserted into the insertion aperture to retain the terminal assembly in the second insertion hole of the housing.

14. The connector according to claim 9, wherein the terminal position assurance member is mounted in the first insertion hole via the first insertion member, and the second insertion member retains the terminal base within the second insertion hole.

15. The connector according to claim 9, wherein said at least two protrusions are arranged to be staggered from one another along a width direction of the first insertion member.

16. The connector according to claim 9, wherein lower surfaces of the at least two protrusions are planar surfaces extending perpendicularly from the lateral surface of the first insertion member.

17. The connector according to claim 9, wherein the at least two protrusions comprise an upper protrusion and a lower protrusion, wherein an upper surface of the upper protrusion is an oblique surface.

18. The connector according to claim 9, wherein the at least two protrusions comprise an upper protrusion and a lower protrusion, wherein an upper surface of the lower protrusion is a planar surface extending perpendicularly from the lateral surface of the first insertion member.

19. The connector according to claim 9, wherein the at least two protrusions comprise an upper protrusion and a lower protrusion, upper surfaces of some of the lower protrusions are planar surface extending perpendicularly from the lateral surfaces of the first insertion members; upper surfaces of some of the lower protrusions are oblique surfaces.

* * * * *